United States Patent [19]

Tyree

[11] 4,351,393

[45] Sep. 28, 1982

[54] NOZZLE HAVING DEFLECTOR FOR PRESSURIZED FIRE SUPPRESSION FLUID

[75] Inventor: Charles N. Tyree, Blue Springs, Mo.

[73] Assignee: Fike Metal Products Corp., Blue Springs, Mo.

[21] Appl. No.: 209,714

[22] Filed: Nov. 24, 1980

[51] Int. Cl.[3] ..... A62C 37/08

[52] U.S. Cl. ..... 169/37; 239/288.5

[58] Field of Search ..... 169/37, 54; 239/288, 239/288.5, 390, 397, 504, 524, 208

[56] References Cited

U.S. PATENT DOCUMENTS

| | | | |
|---|---|---|---|
| 1,667,425 | 4/1928 | Loepsinger | 169/37 |
| 3,039,536 | 6/1962 | Moore et al. | 169/37 |
| 3,313,353 | 4/1967 | Williamson et al. | 239/288 |
| 4,213,567 | 7/1980 | McIntire | 169/37 |

FOREIGN PATENT DOCUMENTS

| | | | |
|---|---|---|---|
| 537020 | 12/1955 | Italy | 239/288.5 |

*Primary Examiner*—Joseph J. Rolla
*Assistant Examiner*—Kenneth Noland
*Attorney, Agent, or Firm*—Schmidt, Johnson, Hovey & Williams

[57] ABSTRACT

A tubular discharge nozzle for spraying a pressurized fire suppression liquid from immediately beneath a ceiling in a fire sprinkling system is provided with a hollow, dome-shaped, ceiling protective shield disposed to deflect the laterally directed high velocity fluid streams downwardly away from the ceiling while, at the same time, permitting low volume escape of the fluid upwardly from the shield toward the ceiling through slots so located in the shield as to produce low velocity secondary plumes which cravitate exteriorly of the shield to merge with the primary streams and thereby maintain the needed, wide spray pattern below the nozzle-shield unit.

9 Claims, 6 Drawing Figures

NOZZLE HAVING DEFLECTOR FOR PRESSURIZED FIRE SUPPRESSION FLUID

BACKGROUND OF THE INVENTION

Sprinkler systems in widespread use for protection against fire in buildings are provided with liquid discharge nozzles adjacent the ceilings so distributed that when the temperature in a zone reaches a predetermined point the fire suppressant is released for free sprinkling in the neighborhood of the excessive heat. Many types of ceilings are extensively damaged by the high velocity streams jetting from the nozzles and impinging on the ceilings; therefore, many attempts have been made, without good results, to effectively shield the ceiling against such damage while, at the same time, not adversely affecting fluid delivery or adequate spread of the spray pattern.

To solve the problem, a dome-shaped shield is mounted on the nozzle therearound to present a fluid-deflecting hood between the ceiling and the high velocity streams radiating from the nozzle. The inner concave surface of the hollow shield is so disposed relative to the fluid emanating radially from the nozzle as to avoid abrupt change in the direction of flow as the streams impinge thereon, and preclude jetting directly against the ceiling.

The result of such construction, without more, would be to unduly confine the spray around the nozzle and thereby undesirably reduce the area of fluid distribution within the space to be protected. Therefore, a portion of the fluid is permitted to escape through strategically located, slotted ports in the shield with the escaping fluid moving in low velocity plumes which cause no ceiling damage yet gravitate exteriory of the shield and merge with the primary streams in the required, widespread, spray pattern below the nozzle-deflector unit.

DESCRIPTION OF THE PREFERRED EMBODIMENT

Figure 1:
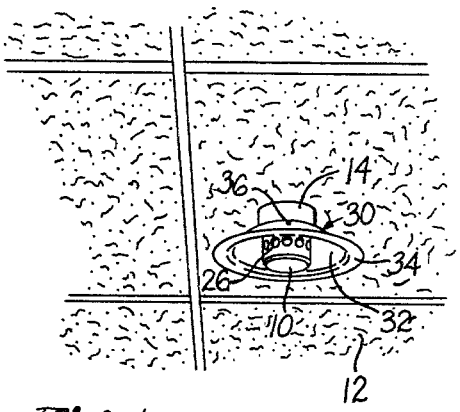
FIG. 1 is a perspective view of a nozzle having a deflector for pressurized fire suppression fluid made pursuant to the present invention.

A tubular spray nozzle 10 of a fire sprinkling system, disposed beneath and depending from a ceiling 12, has an enlarged, internally tapped head 14 connected with external screw threads 16 of a liquid outlet pipe 18 emanating from a fluid pressure tank 20 above the ceiling 12 on a support 22, the tank 20 containing a fire suppressive fluid which is delivered to the space beneath the ceiling 12 in response to conventional temperature-sensing means, not shown. The pipe 18, which places the nozzle 10 into communication with the tank 20, projects downwardly through an aperture 24 in the ceiling 12, and the head 14 abuts the lower face of the ceiling 12.

The nozzle 10 has a number of circumferentially spaced, fluid dispensing orifices 26 therearound for converting the pressure existing in the fluid into velocity and throttling the discharged fluid into small streams 28 jetting radially from the nozzle 10, the lowermost end of the nozzle 10 being closed.

A device in the nature of a hollow shield 30 is attached to the nozzle 10 in surrounding relationship thereto for protecting the ceiling 12 against damage which would otherwise result from the force of the high velocity streams 28 striking the lower face of the ceiling 12. The dome-shaped shield 30 has an uppermost, central aperture 31 which receives the nozzle 10 above the equally spaced orifices 26 such that the top of the shield 30 abuts the head 14 and is thereby held spaced from the ceiling 12 therebelow and spaced from the orifices 26 thereabove.

The essentially hemispherical shield 30 presents a downwardly-facing concavity therewithin such that inner and lower, concave surface 32 of the shield 30 is disposed within the path of the streams 28. The surface 32 is spaced outwardly of the orifices 26, and as the streams 28 impinge upon the surface 32, a portion of the liquid flow is deflected downwardly away from the ceiling 12.

The shield 30 terminates below the orifices 26 in a lowermost, continuous, annular, planar outwardly extending, peripheral flange 34 that is in spaced parallelism with the ceiling 12.

Figure 5:
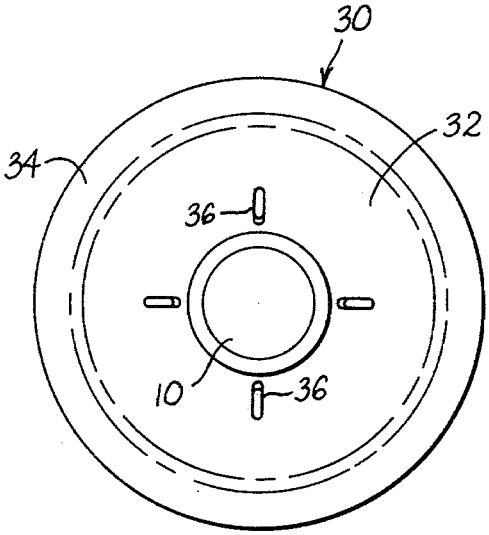
FIG. 5 is an enlarged view looking into the unit from the bottom thereof.
Figure 6:
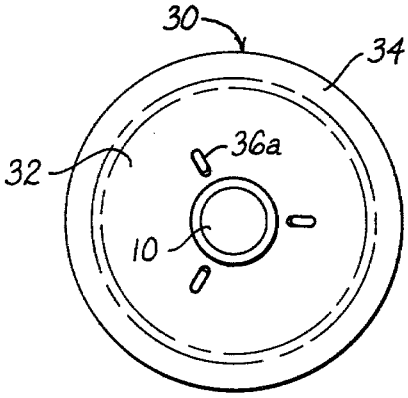
FIG. 6 is a view similar to FIG. 5 showing a modification of the unit.

The shield 30 has a number of circumferentially spaced, fluid escape ports in the nature of elongated slots 36 disposed above the orifices 26 adjacent the nozzle 10 and spaced from the aperture 24. Four such equally spaced slots 36 are shown in FIG. 5 whereas it has been found that but three slots **36*a* may be needed under certain circumstances as illustrated in FIG. 6. The longitudinal axes of the slots 36 and 36*a* extend downwardly and outwardly in relation to the aperture 24 such that the U-shaped plumes 38 of liquid emanating therefrom gravitate exteriorly of the shield 30 with, at most, only a light, non-damaging engagement with the ceiling 12 because the jet force of the liquid diminishes quite appreciably inasmuch as the liquid must rise before passing outwardly through the slots 36 into the plumes 38**.

Figure 2:
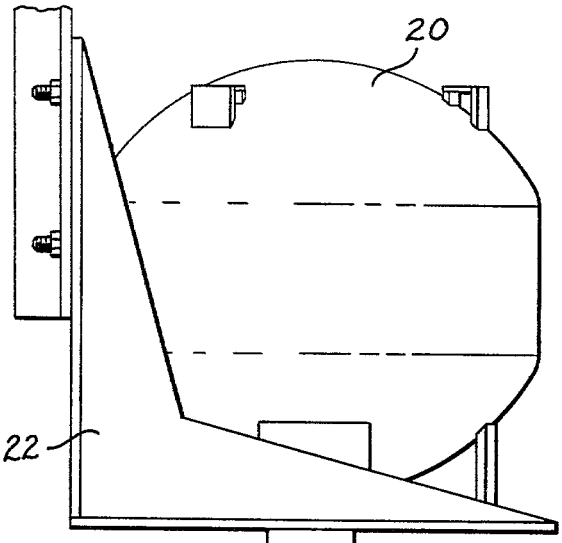
FIG. 2 is an enlarged cross-sectional view through the deflector and through a portion of the ceiling from which the nozzle depends, together with a fluid supply tank above the ceiling.
Figure 3:
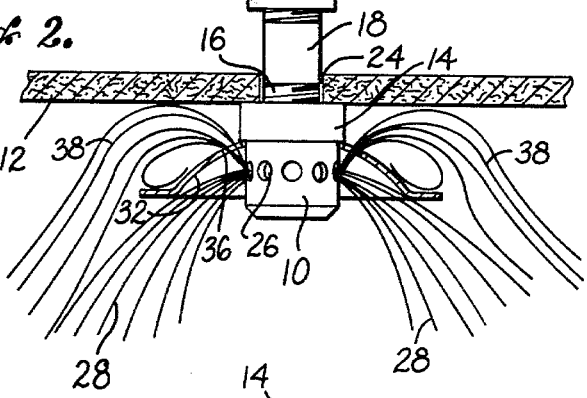
FIG. 3 is a side elevational view of the nozzle-deflector unit still further enlarged.
Figure 3:
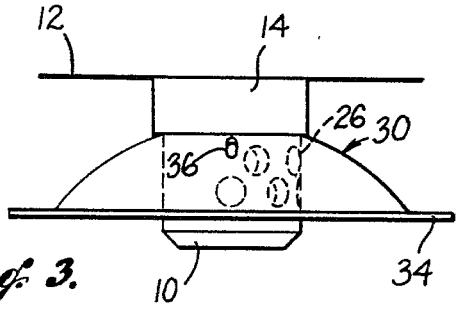
Figure 4:
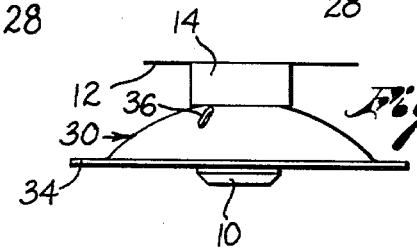
FIG. 4 is a view similar to FIG. 3 but on a reduced scale and at a slightly different position of the parts.

Noteworthy also is the fact that the surface 32 absorbs the force of the liquid along the slots 36 such that the velocity of the liquid passing through the slots 36 is sufficient to result in deleterious affects on the ceiling 12. Yet, the presence of the shield 30 above and around the nozzle 10 does not substantially reduce the widespread pattern of the totality of the spray gravitating from the nozzle-shield unit because of the fact that the plumes 38 effectively merge with the streams 28 around the outer edge of the flange 34 and therebelow as depicted in FIG. 2.

I claim:

1. In a fire sprinkling system for delivering a fire suppressing fluid initially in liquified form from a fluid pressure tank in response to temperature-sensing means, a tubular spray nozzle for placement into communication with said tank and disposition adjacent a ceiling in depending relationship thereto, said nozzle having a number of circumferentially spaced, fluid discharge orifices therearound for converting the pressure existing in said fluid into velocity and throttling the fluid discharged therefrom into small streams radiating from the nozzle; and a device for protecting the ceiling against damage which would otherwise result from the force of said streams jetting thereagainst, said device including a hollow shield attached to and surrounding the nozzle between the ceiling and said orifices, said shield being provided with a lower, fluid impinging surface within the path of said streams and spaced outwardly of said orifices, said surface being shaped and disposed to deflect a portion of the fluid flow downwardly away from the ceiling, there being a lowermost continuous, annular, planar, outwardly extending, peripheral flange in spaced parallelism with the ceiling below said orifices operable to preclude impingement of the high velocity fire suppressant streams against adjacent portions of the ceiling.

2. The invention of claim 1, said nozzle having an enlarged, internally tapped head adapted for connection with external screw threads of a fluid outlet pipe emanating from the tank and projecting downwardly through the ceiling, said head abutting the ceiling and the shield.

3. The invention of claim 1, said shape of said shield being concave.

4. The invention of claim 1, said shield being essentially hemispherical presenting a downwardly-facing concavity.

5. The invention of claim 1, said shield having a number of fluid escape ports.

6. The invention of claim 5, said ports being disposed above the orifices adjacent the nozzle.

7. The invention of claim 1, said shield being dome-shaped, presenting a downwardly-facing concavity, and having an uppermost, central, nozzle-receiving aperture.

8. The invention of claim 7, said shield having a number of circumferentially spaced, fluid escape slots above the orifices adjacent and spaced from said aperture.

9. The invention of claim 8, said slots having inclined longitudinal axes extending outwardly and downwardly from said aperture.

* * * * *